US010705448B2

(12) United States Patent
Nakajima

(10) Patent No.: US 10,705,448 B2
(45) Date of Patent: Jul. 7, 2020

(54) IMAGE FORMING APPARATUS PERFORMING PHASE CONTROL OF ROTATIONAL POLYGON MIRROR

(71) Applicant: CANON KABUSHIKI KAISHA, Tokyo (JP)

(72) Inventor: Yuki Nakajima, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/387,342

(22) Filed: Apr. 17, 2019

(65) Prior Publication Data

US 2019/0324380 A1 Oct. 24, 2019

(30) Foreign Application Priority Data

Apr. 20, 2018 (JP) ..... 2018-081554
Feb. 12, 2019 (JP) ..... 2019-022805

(51) Int. Cl.
*G03G 15/043* (2006.01)

(52) U.S. Cl.
CPC ..... *G03G 15/043* (2013.01)

(58) Field of Classification Search
CPC ..... G03G 15/043; G02B 26/127
See application file for complete search history.

(56) References Cited

U.S. PATENT DOCUMENTS

2011/0129244 A1* 6/2011 Shoji ..... G03G 15/011 399/51
2012/0033025 A1* 2/2012 Kiyama ..... G02B 26/127 347/261
2016/0150113 A1* 5/2016 Sato ..... H04N 1/00891 358/300
2017/0269501 A1* 9/2017 Kamikura ..... H04N 1/0473
2018/0106998 A1* 4/2018 Furuta ..... G02B 26/124
2019/0079437 A1* 3/2019 Motoyama ..... G03G 15/5004

FOREIGN PATENT DOCUMENTS

JP H07-035995 A 2/1995
JP 2003149585 A 5/2003
JP 2011150292 A 8/2011

* cited by examiner

*Primary Examiner* — Sevan A Aydin
(74) *Attorney, Agent, or Firm* — Canon U.S.A., Inc. IP Division

(57) ABSTRACT

In a case of performing a second rotation control to match the rotation phase of a first rotational polygon mirror with the rotation phase of a second rotational polygon mirror in a rising period, a period during which a non-image region is irradiated with light from both or one of a first light source and a second light source is controlled to be a second period longer than a first period.

16 Claims, 8 Drawing Sheets

IMAGE FORMING APPARATUS PERFORMING PHASE CONTROL OF ROTATIONAL POLYGON MIRROR

BACKGROUND OF THE INVENTION

Field of the Invention

The present invention relates to an image forming apparatus such as an electrophotographic printer that performs exposure with laser light.

Description of the Related Art

Conventionally, there has been known an image forming apparatus that includes a plurality of scanner units having a rotational polygon mirror and periodically performs scanning with a laser beam to form an electrostatic latent image on the photosensitive drum. Japanese Patent Laid-Open No. 2003-149585 proposes performing phase control in such an image forming apparatus to adjust the rotation phases of motors that drive the rotational polygon mirrors in the plurality of scanner units.

The phase control as in the conventional art is performed in a relatively stable state in which the rotation speeds of the rotational polygon mirrors are close to a target speed to some extent after completion of the activation control of the motors for driving the rotational polygon mirrors. In other words, separately performing the activation control and the phase control may increase the time required until image formation is started.

SUMMARY OF THE INVENTION

An image forming apparatus includes:

a first light source;

a first rotational polygon mirror having a plurality of reflecting surfaces and configured to deflect light emitted from the light source while rotating;

a first drive unit configured to drive the first rotational polygon mirror;

a first detection unit configured to detect the light deflected by the first rotational polygon mirror;

a second light source;

a second rotational polygon mirror having a plurality of reflecting surfaces and configured to deflect light emitted from the light source while rotating;

a second drive unit configured to drive the second rotational polygon mirror;

a second detection unit configured to detect the light deflected by the second rotational polygon mirror; and a control unit configured to control driving of the first drive unit based on a result detected by the first detection unit, control driving of the second drive unit based on a result detected by the second detection unit, and control a period during which light is emitted from the first light source and the second light source, wherein the control unit causes the first light source and the second light source to irradiate an image region on a photosensitive member with light to form an electrostatic latent image, and causes the first light source and the second light source to irradiate a non-image region outside of the image region with light so that the first detection unit and the second detection unit detect the light, and wherein, in a rising period in which the first rotational polygon mirror and the second rotational polygon mirror are accelerated to reach a rotation speed for image forming, in a case of performing a first rotation control for controlling rotation speeds of the first rotational polygon mirror and the second rotational polygon mirror, the control unit causes the first light source and the second light source to irradiate the non-image region with light in a first period and independently controls the rotation speeds of the first rotational polygon mirror and the second rotational polygon mirror, and in the rising period, in a case of performing a second rotation control to match a rotation phase of the first rotational polygon mirror with a rotation phase of the second rotational polygon mirror, the control unit controls a period during which both or one of the first light source and the second light source irradiate the non-image region with light to be a second period longer than the first period.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings. The following embodiments are not intended to limit the present invention according to the claims. In addition, all the combinations of characteristics described in relation to the embodiments are not necessarily essential to the solution of the present invention.

First Embodiment

Figure 1:
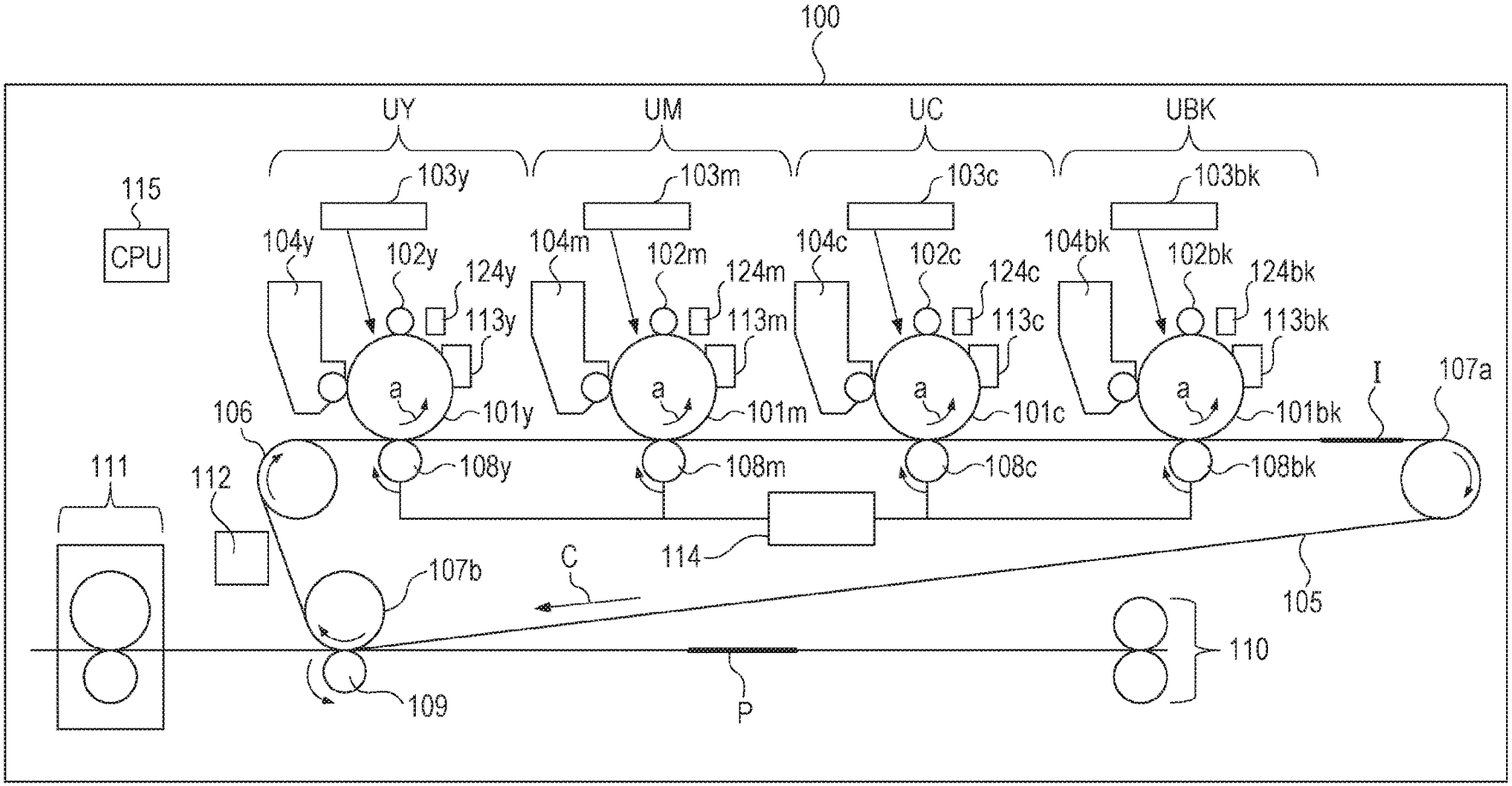
FIG. 1 is a schematic configuration diagram of an image forming apparatus.

FIG. 1 is a schematic configuration diagram of an image forming apparatus 100. In the following description, an intermediate transfer-type color image forming apparatus will be taken as an example, but a rotary-type color image forming apparatus or a direct transfer-type color image forming apparatus may be used instead, for example. In the following description, the suffixes Y, M, C, and BK on the reference numerals may be omitted for the sake of convenience of explanation, particularly for members which need no distinctions among yellow, magenta, cyan, and black.

As illustrated in FIG. 1, a photosensitive drum 101 (101*y*, 101*m*, 101*c*, 101*bk*) as a photosensitive member is rotated in the direction of arrow a. Further, the surface of the photosensitive drum 101 is uniformly charged by a contact-type charge roller 102 (102*y*, 102*m*, 102*c*, 101*bk*) as a charging unit. A laser scanner unit 103 (103*y*, 103*m*, 103*c*, 103*bk*) as a scanning unit scans the photosensitive drum 101 with light to exposes the surface of the photosensitive drum 101, thereby forming an electrostatic latent image on the photosensitive drum 101 (on the photosensitive member). A development device 104 (104*y*, 104*m*, 104*c*, 104*bk*) as a development unit applies a development bias to develop with toner (developer) the electrostatic latent image formed on the photosensitive drum 101 as a toner image.

According to the rotation of the photosensitive drum 101, the toner image developed by the development device 104 is conveyed to a primary transfer portion formed between an intermediate transfer belt 105 as an intermediate transfer member and the photosensitive drum 101. The intermediate transfer belt 105 rotates in the direction of an arrow c in contact with the photosensitive drum 101. The toner image having reached the primary transfer portion is primary-transferred by application of a predetermined primary transfer bias from a high-voltage power supply 114 to a primary transfer roller 108 (108*y*, 108*m*, 108*c*, 108*bk*) as a primary transfer unit in pressure contact with the toner image via the intermediate transfer belt 105. A conductive roller is used for the primary transfer roller 108. The intermediate transfer belt 105 is stretched and driven by a drive roller 106 and support rollers 107*a* and 107*b*. The toner images formed by the toner of respective colors in image forming units UY, UM, UC, and UBK are sequentially superimposed on the intermediate transfer belt 105 to form an image I.

The image I formed on the intermediate transfer belt 105 is conveyed to a secondary transfer portion formed by a secondary transfer roller 109 and the intermediate transfer belt 105. When the image I reaches the secondary transfer portion, a secondary transfer bias is applied to the secondary transfer roller 109 to perform secondary transfer of the image I to a recording material P fed by a paper feed unit 110 from a paper feeding cassette not illustrated. The recording material P on which the image has been secondarily transferred is separated from the intermediate transfer belt 105 by the curvature with the support roller 107*b* and is conveyed to a fixing device 111. Then, the image is fixed on the recording material P by being heated and pressed by the fixing device 111. The recording material P on which the image has been fixed is discharged to the outside of the image forming apparatus.

On the other hand, the residual toner on the photosensitive drum 101 after the primary transfer is cleaned by a photosensitive drum cleaner 113 (113*y*, 113*m*, 113*c*, 113*bk*). Thereafter, the potential of the surface of the photosensitive drum 101 is uniformly discharged by a pre-exposure lamp 124 (124*y*, 124*m*, 124*c*, 124*bk*) to perform the next image formation. After the secondary transfer of the image onto the recording material P, the surface of the intermediate transfer belt 105 is cleaned by an intermediate transfer belt cleaner 112. A CPU 115 as a control unit controls the operations of the image forming units including the laser scanner unit 103 and governs the execution of the above-described sequential image forming process.

Figure 2:
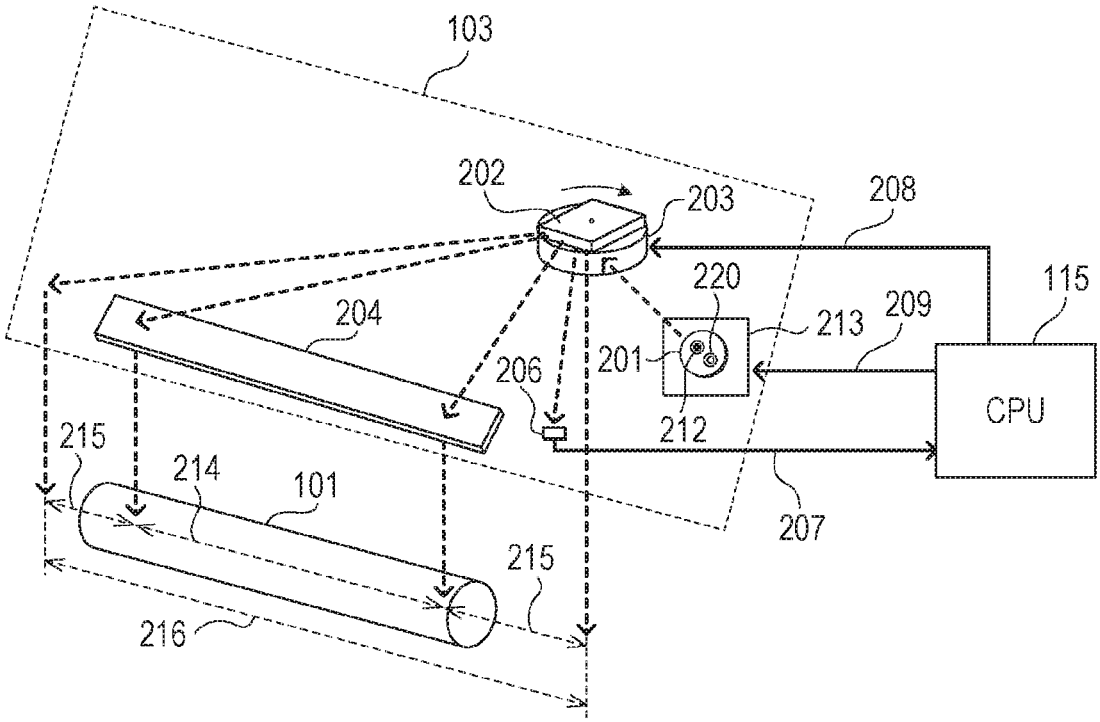
FIG. 2 is a schematic configuration diagram of a laser scanner unit.

FIG. 2 is a schematic configuration diagram of the laser scanner unit 103 as scanning unit. A semiconductor laser 201 as a light source for irradiation is formed from one laser diode 212 and one photodiode 220, and its light emission is controlled by a laser drive circuit 213. A scanner motor 203, as an example of a rotation drive unit, rotates a polygon mirror 202 as a rotational polygon mirror having a plurality of reflecting surfaces and deflecting light by the reflecting surfaces, in the direction of rotation illustrated in the figure.

The laser light reflected by the rotational operation of the polygon mirror 202 is used to periodically scan a full-scanning region 216. The full-scanning region 216 is divided into an image region 214 and a non-image region 215. The image region 214 refers to a region where the surface of the photosensitive drum 101 is irradiated with the laser light reflected by the polygon mirror 202 through a reflecting mirror 204. On the other hand, the non-image region 215 refers to a region excluding the image region 214 of the full-scanning region 216.

A beam detect (BD) sensor 206 as a detection unit is disposed in a predetermined place in the non-image region 215. When irradiated with the laser light, the BD sensor 206 outputs a main scanning synchronization signal 207. The main scanning synchronization signal 207 will also be referred to as BD signal 207 hereinafter. The cycle in which the BD signal 207 is generated will also be referred to as BD cycle. The BD signal 207 is used as a scanning start reference signal in a main scanning direction to control a writing start position in the main scanning direction.

Every time the BD signal 207 is generated, the CPU 115 sequentially stores the BD cycle in the memory. Then, based on the current value of the stored BD cycle, the CPU 115 controls the scanner motor 203 and the semiconductor laser 201. That is, the CPU 115 transmits a scanner motor drive signal 208 to the scanner motor 203, and accelerates the scanner motor 203 when the rotation speed corresponding to the current value of the BD cycle is lower than a preset target rotation speed, and decelerates the scanner motor 203 when the rotation speed is higher than the preset target rotation speed. In this manner, the CPU 115 performs speed control to converge the scanner motor 203 to the target rotation speed. In addition, the CPU 115 transmits a laser drive signal 209 to the laser drive circuit 213, and controls a predetermined position of the semiconductor laser 201 in the full-scanning region 216 and the light emission timing for scanning the BD sensor 206.

The semiconductor laser 201, the scanner motor 203, the BD signal 207, the scanner motor drive signal 208, and the laser drive signal 209 illustrated in FIG. 2 are in common among the individual laser scanner units 103. That is, these components can also be referred to as the semiconductor laser 201 (201*y*, 201*m*, 201*c*, 201*bk*), the scanner motor 203 (203*y*, 203*m*, 203*c*, 203*bk*), and the BD signal 207 (207*y*, 207*m*, 207*c*, 207*bk*). In addition, these components can also be referred to as the scanner motor drive signal 208 (208*y*, 208*m*, 208*c*, 208*bk*) and the laser drive signal 209 (209*y*, 209*m*, 209*c*, 209*bk*). Moreover, the BD sensor 206 may be in common among the individual laser scanner units 103. That is, when four BD sensors are provided, they can also be referred to as BD sensor 206 (206*y*, 206*m*, 206*c*, 206*bk*). However, as described above, the suffixes Y, M, C, and BK of the reference numerals may be omitted for the sake of convenience of explanation, particularly for members which need no distinctions among yellow, magenta, cyan, and black.

Next, a method of rotation phase control for adjusting the rotation phases of the scanner motors 203 will be described. In order to correct the color deviations in the image I illustrated in FIG. 1, the CPU 115 adjusts the image writing timings of the laser scanner units 103*y*, 103*m*, 103*c*, and 103*bk*. Specifically, by adjusting the rotation phases of the scanner motors 203*y*, 203*m*, 203*c*, and 203*bk*, the image writing timings can be adjusted within the range of less than one line in a sub scanning direction.

The CPU 115 calculates optimum rotation phases of the scanner motors 203*y*, 203*m*, 203*c*, and 203*bk*, and performs the rotation phase control so as to keep the calculated rotation phases during image formation. In the present embodiment, the CPU 115 generates a reference BD signal 207*r* as a reference for the rotation phase control. Then, the CPU 115 calculates the phase differences between the reference BD signal 207*r* and the BD signals 207*y*, 207*m*, 207*c*, and 207*bk* and controls the individual phase differences to coincide with target phase differences, thereby implementing the rotation phase control. The cycle of the reference BD signal 207*r* is changed according to the rotation speeds of the scanner motors 203*y*, 203*m*, 203*c*, and 203*bk*. For example, the BD cycle of the reference BD signal 207*r* is determined based on the average value of the BD cycles of the BD signals 207*y*, 207*m*, 207*c*, and 207*bk*.

Figure 3:
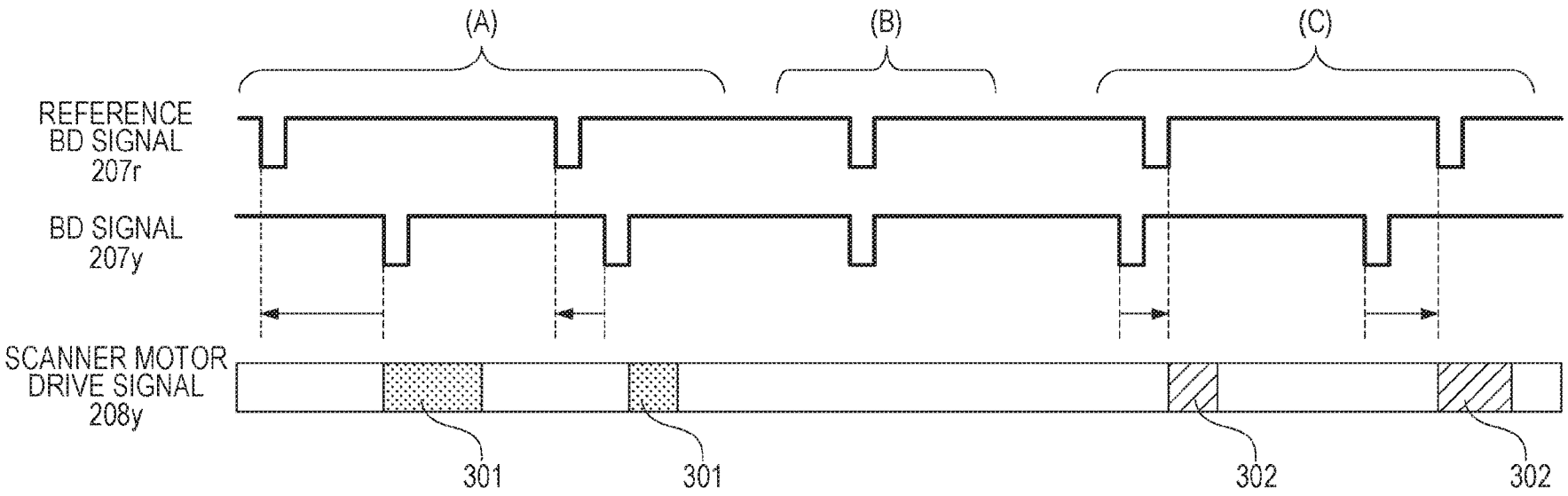
FIG. 3 is a diagram illustrating the relationship between BD signal and scanner motor drive signal in rotation phase control.

FIG. 3 is a diagram illustrating the relationship between the BD signal and the scanner motor drive signal in the rotation phase control in the present embodiment. Although the following description will be provided taking the laser scanner unit 103*y* as an example, the rotation phase control can also be performed on the laser scanner units 103*m*, 103*c*, and 103*bk* by the same method.

First, the CPU 115 detects a falling of the BD signal 207*y* and calculates a BD phase difference which is a result of comparison with the reference BD signal 207*r*. Then, the CPU 115 performs acceleration/deceleration control of the scanner motor 203*y* so that the BD phase difference coincides with a target BD phase difference. In FIG. 3, the target BD phase difference is set to 0 for the convenience of explanation. However, the present invention is not limited to this, and the target BD phase difference can be appropriately set in accordance with the accuracy to be obtained. For example, the target BD phase difference can be specified as an arbitrary value less than one cycle of the BD signal. When the BD phase difference and the target BD phase difference are different, the CPU 115 determines whether to accelerate or decelerate the rotation of the scanner motor 203*y*. As an example of determination criterion, the determination is made as to which one approaches the target BD phase difference earlier. The CPU 115 outputs either an acceleration signal 301 or a deceleration signal 302 via the scanner motor drive signal 208*y*.

With regard to the example of FIG. 3, FIG. 3(A) illustrates a state in which the BD signal 207*y* at the rotation phase to be controlled is behind the reference BD signal 207*r* at the reference rotation phase. FIG. 3(B) illustrates a state in which there is a coincidence between the reference BD signal 207*r* at the reference rotation phase and the BD signal 207*y* as the rotation phase to be controlled. FIG. 3(C) illustrates a state in which the BD signal 207*y* at the rotation phase to be controlled is ahead of the reference BD signal 207*r* at the reference rotation phase. The CPU 115 outputs the acceleration signal 301 in the state of FIG. 3(A), and outputs the deceleration signal 302 in the state of FIG. 3(C). The output widths of the acceleration signal 301 and the deceleration signal 302 may be increased or decreased according to the magnitude of the error from the target BD phase difference. By executing such determination in each BD cycle, the CPU 115 controls the BD phase difference to coincide with the target BD phase difference.

The CPU 115 superimposes the acceleration/deceleration signal used in the rotation speed control of the scanner motor 203*y* and the acceleration/deceleration signal used in the rotation phase control of the scanner motor 203*y* on the scanner motor drive signal 208*y* and outputs the superimposed result, thereby to execute the rotation speed control and the rotation phase control at the same time. Normally, at the activation of the laser scanner unit 103*y*, it is preferred to execute the rotation speed control first, and then execute the rotation phase control after the scanner motor 203*y* reaches the target rotation speed so that the rotation phase control can be implemented by a simpler configuration. However, in order to shorten the activation time of the image forming apparatus 100, it is preferred to execute the rotation phase control before the scanner motor 203*y* reaches the target rotation speed so that the rotation control of the scanner motor 203*y* can be performed in a shorter time.

Figure 4:
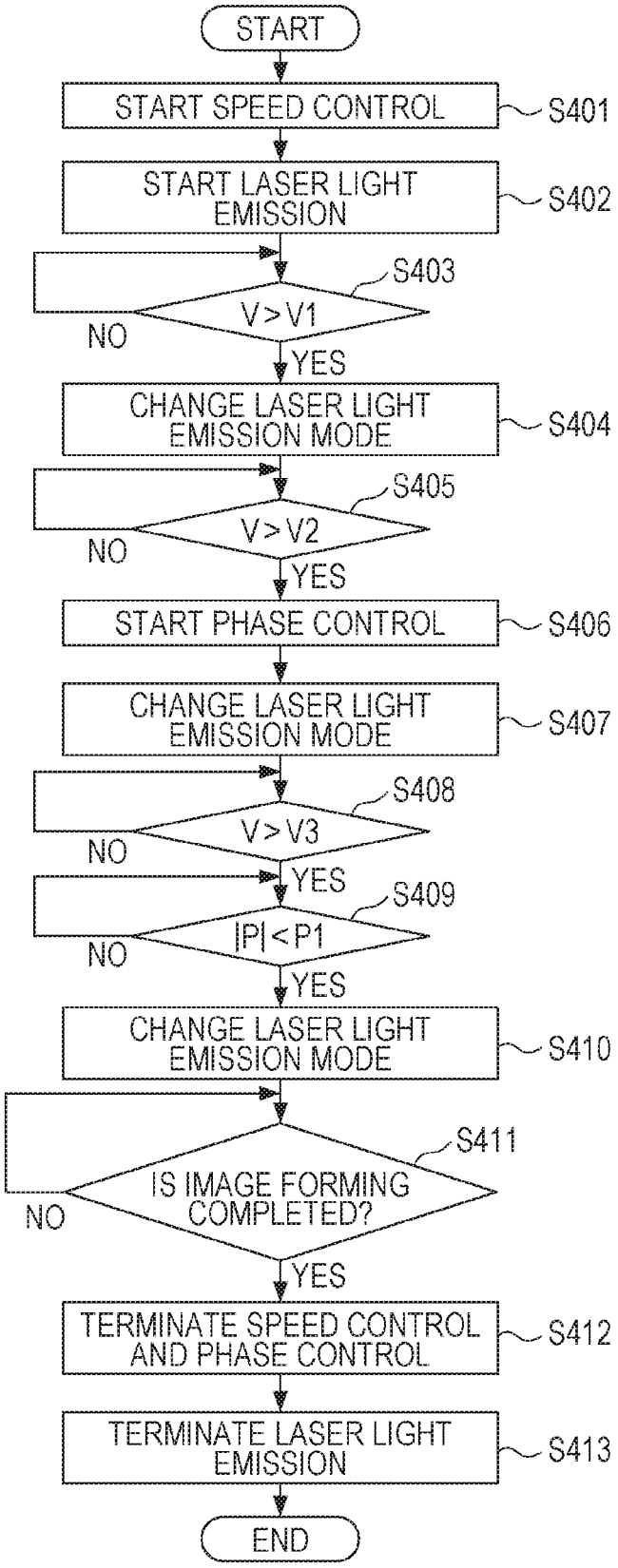
FIG. 4 is a flowchart relating to rotation control of a laser scanner.
Figure 5:
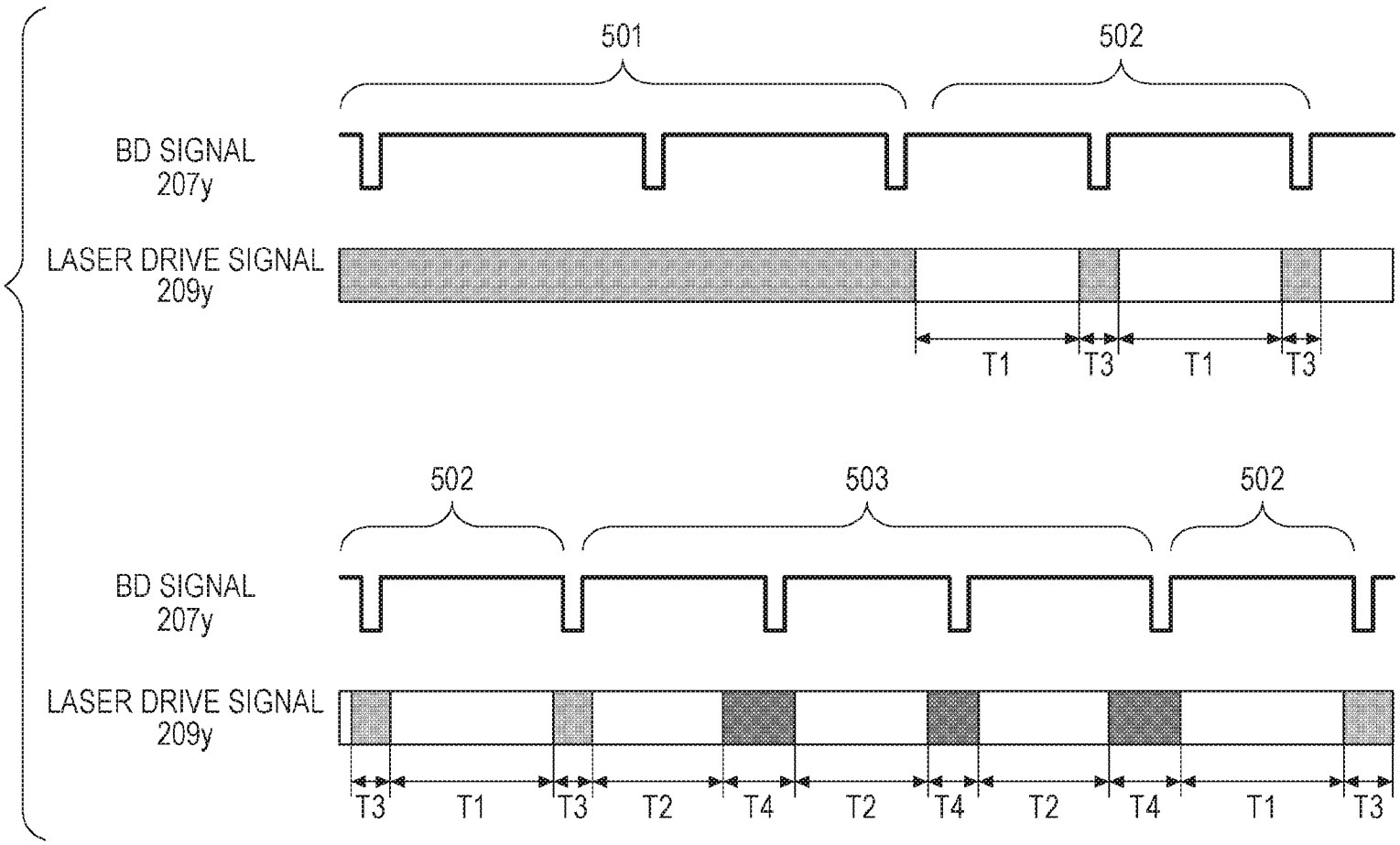
FIG. 5 is a diagram illustrating the relationship between BD signal and laser drive signal.

FIG. 4 is a flowchart relating to the rotation control of the laser scanner in the present embodiment. FIG. 5 is a diagram illustrating the relationship between the BD signal and the laser drive signal in the present embodiment. In S401, when the laser scanner unit 103*y* is activated, the CPU 115 starts the rotation speed control of the scanner motor 203*y*. In S402, the CPU 115 starts laser light emission from the semiconductor laser 201*y*. Since the rotation speed of the scanner motor 203*y* is unknown immediately after the activation of the laser scanner unit 103*y*, the BD cycle cannot be predicted either. Therefore, the semiconductor laser 201*y* emits light as in a first light emission mode 501 illustrated in FIG. 5. In other words, in the first light emission mode 501, forced light emission control is performed to irradiate the full-scanning region 216, that is, an entire region of both the image region 214 and the non-image region 215 with laser light. By performing such light emission, it is possible to acquire the BD signal 207*y* whatever the rotation speed V of the scanner motor 203*y* is. As far as the BD sensor 206 can detect the BD signal, the irradiation region of laser light is not necessarily limited to the entire region of both the image region 214 and the non-image region 215.

In S403, the CPU 115 determines whether the rotation speed V of the scanner motor 203*y* has reached a predetermined rotation speed V1. When the rotation speed V of the scanner motor 203*y* has reached the rotation speed V1, in S404, the CPU 115 changes the light emission mode of the semiconductor laser 201*y* from the first light emission mode 501 to a second light emission mode 502. The CPU 115 predicts the timing of acquiring the BD signal 207*y* in the second light emission mode 502 from the BD signal 207*y* acquired in the first light emission mode 501. In the second light emission mode 502, the CPU 115 controls the laser drive signal 209*y* so that the non-image region 215 is irradiated with laser light. That is, laser light irradiation is performed in a period T3 illustrated in FIG. 5. By turning off the laser light after acquiring the BD signal 207*y* in the period T3, the CPU 115 controls the laser drive signal 209*y* so that image region 214 is not irradiated with the laser light. That is, no laser light irradiation is performed during a period T1 illustrated in FIG. 5. By controlling the light emission in this way, it is possible to suppress irradiation of the image region 214 with laser light during non-image formation, thereby suppressing deterioration of the photosensitive drum 101*y*. In other words, independently controlling the rotation speeds of a first rotational polygon mirror and a second rotational polygon mirror by irradiating the non-image forming region with light may be referred to as a first rotation control.

In S405, the CPU 115 determines whether the rotation speed V of the scanner motor 203*y* has reached a rotation speed V2, which is a higher speed than the rotation speed V1. When the rotation speed V of the scantier motor 203*y* has reached the rotation speed V2, in S406, the CPU 115 starts the rotation phase control of the laser scanner unit 103*y*. Upon start of the rotation phase control, in S407, the CPU 115 changes the light emission mode of the semiconductor laser 201*y* from the second light emission mode 502 to a third light emission mode 503. In the third light emission mode 503, the CPU 115 controls the laser drive signal 209*y* so that the non-image region 215 is irradiated with laser light as in the second light emission mode 502. That is, laser light irradiation is performed in a period T4 illustrated in FIG. 5. In the third light emission mode 503, characteristically, the period during which laser light irradiation is performed is in the relationship of T4>T3. In other words, it can also be said that the period during which no laser light irradiation is performed is in the relationship of T2<T1. As an example, in the present embodiment, the start time of T3 is decided to be after a lapse of a period 0.98 times the previous BD cycle since the acquisition of the BD signal 207*y*, and the start time of T4 is decided to be after a lapse of a period 0.95 times the previous BD cycle since the acquisition of the BD signal 207*y*. That is, a first coefficient may be referred to as 0.98 and a second coefficient may be referred to as 0.95. In addition, the end times of T3 and T4 are controlled to be after a lapse of a period 0.01 times the previous BD cycle since the acquisition of the BD signal 207*y*.

The reason for laser light irradiation in the period T4 which is longer than the period T3 is as follows. That is, when the rotation phase control is started, the acceleration signal 301 and the deceleration signal 302 are superimposed on the scanner motor drive signal 208*y* under the rotation phase control, so that the scanner motor 203*y* is likely to be greatly accelerated or decelerated. Accordingly, the rotation speed V of the scanner motor 203*y* may fluctuate. For example, to converge into the target phase difference by over ten rotations of the scanner motor, it is necessary to provide the BD cycle of the BD signal 207*y* with a time difference of about 5% at maximum from the BD cycle of the reference BD signal 207*r* during the phase control time period. Due to the provision of this time difference, even if the fluctuation of the rotation speed V in each BD cycle during the speed control is about 1%, the fluctuation of the rotation speed V in each BD cycle during the rotation phase control may increase to about 2%.

In order to reliably obtain the BD signal 207*y* even with such a fluctuation in the rotation speed V of the scanner motor 203*y*, the irradiation period of the laser light is controlled and set to T4 longer than T3 based on the above-described determination method. However, even in the case of performing the light emission control in the third light emission mode 503, degradation of the photosensitive drum 101*y* can be suppressed by controlling the irradiation period so as not to irradiate the image region 214 as much as possible. In other words, the period during which acceleration is performed to reach the rotation speed in the image-forming period can be referred to as a rising period. In the rising period, controlling and setting a period during which the non-image region is irradiated with light from both or either one of the first light source and the second light source to be a second period longer than a first period can also be referred to as a second rotation control.

In S408, the CPU 115 determines whether the rotation speed V of the scanner motor 203*y* has reached a rotation speed V3, which is a speed higher than the rotation speed V2. When the rotation speed V of the scanner motor 203*y* has reached the rotation speed V3, in S409, the CPU 115 determines whether the absolute value |P| of the phase difference between the reference BD signal 207*r* and the BD signal 207*y* becomes smaller than a predetermined value P1. When determining that the absolute value P1 of the phase difference becomes smaller than P1, the CPU 115 determines that the rotation phase of the scanner motor 203*y* has stabilized. When the rotation phase has stabilized, in S410, the CPU 115 changes the light emission mode of the semiconductor laser 201*y* from the third light emission mode 503 to the second light emission mode 502. That is, the semiconductor laser 201*y* is driven in the third light emission mode 503 during the time from the start of the rotation phase control to the stabilization of the rotation phase, and then the semiconductor laser 201*y* is driven in the second light emission mode 502 when the rotation phase has stabilized.

In S411, the CPU 115 determines whether the image forming has completed. When determining that the image forming has completed, in S412, the CPU 115 terminates the rotation speed control and the rotation phase control of the laser scanner unit 103*y*, and stops the rotation of the scanner motor 203*y*. Further, in S413, the CPU 115 changes the laser drive signal 209*y* to the non-light emission state to terminate the light emission of the semiconductor laser 201*y*.

In this manner, during the period of execution of the rotation phase control, the irradiation period of the semiconductor laser 201*y* for detecting the BD signal 207*y* is lengthened. As a result, even if the rotation speed of the scanner motor 203*y* is accelerated or decelerated by the rotation phase control, the BD signal 207*y* can be reliably detected. That is, even when the rotation acceleration control and the rotation phase control of the polygon mirrors for laser light scanning are performed at the same time to shorten the activation time of the scanning device, the BD signal 207*y* can be stably detected. Further, during the period in which the rotation phase control is not performed, shortening the irradiation period of the semiconductor laser 201*y* for detecting the BD signal 207*y* makes it possible to suppress deterioration of the photosensitive drum 101*y* caused by laser light irradiation. Furthermore, performing the rotation speed control and the rotation phase control of the scanner motor 203*y* in parallel makes it possible to suppress increase of the time taken to start the image forming.

In the present embodiment, the timing of starting the rotation phase control and the timing of changing the light emission mode are determined based on the rotation speed V of the scanner motor 203*y*, but the present invention is not limited thereto. For example, the timing of starting the rotation phase control and the timing of changing the light emission mode may be determined by measuring the elapsed time from the start of activation of the laser scanner unit 103*y*. Further, in the present embodiment, the number of laser scanner units is four as an example, but the number of laser scanner units is not limited thereto. For example, the number of laser scanner units may be one for yellow and magenta and one for cyan and black, which is two in total. Such control as in the present embodiment can be applied to any configuration in which rotation phase control is performed between laser scanner units.

Second Embodiment

In relation to the first embodiment, the method of aligning the rotation phases of the scanner motor 203*y* by accelerating and decelerating in the rotation phase control has been described. In relation to the present embodiment, a method of aligning the rotation phases of the seamier motors 203*y* by decreasing the frequency of decelerating the scanner motors 203*y* in rotation phase control will be described. Detailed descriptions of components similar to those of the first embodiment such as the components of an image forming apparatus will be omitted here.

Figure 6:
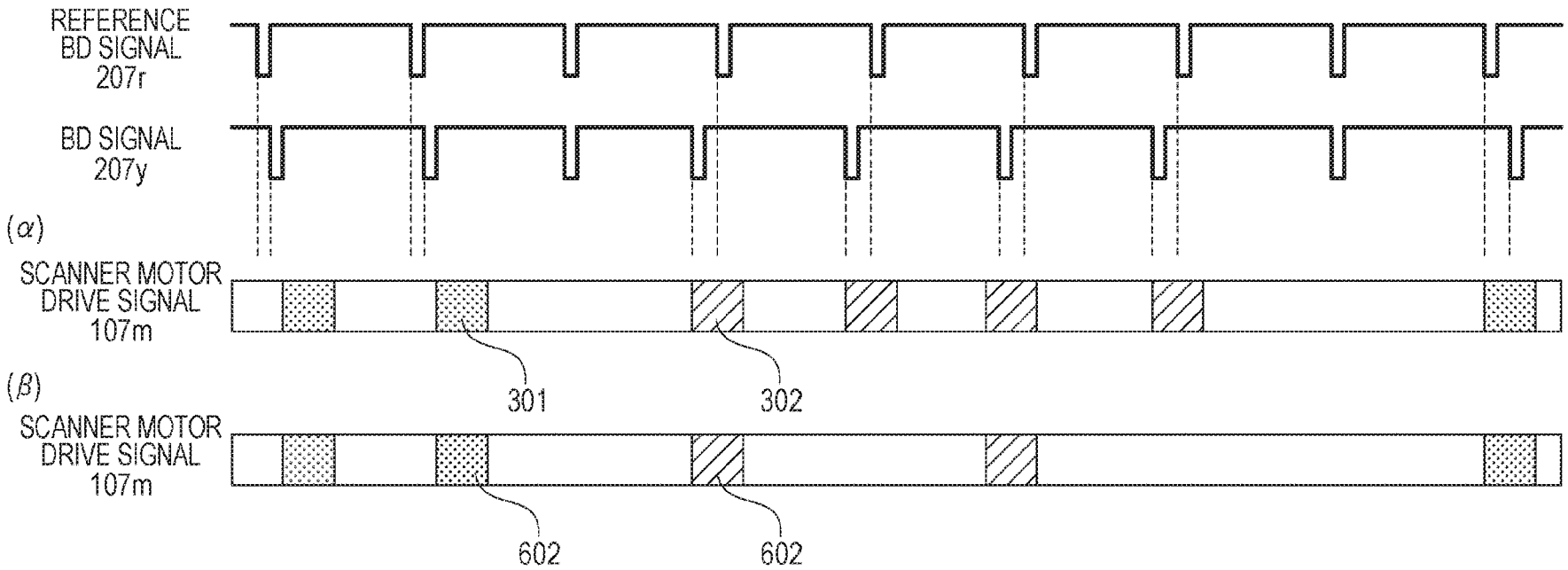
FIG. 6 is a diagram illustrating the relationship between BD signal and scanner motor drive signal in rotation phase control.

FIG. 6 is a diagram illustrating the relationship between BD signal and scanner motor drive signal in the rotation phase control in the present embodiment. In the present embodiment, a CPU 115 controls a rotation phase while switching between two rotation phase control methods. As in the first embodiment, in a first rotation phase control (α), the CPU 115 outputs an acceleration signal 301 or a deceleration signal 302 on the basis of the phase difference between a reference BD signal 207*r* and a BD signal 207*y* to control the rotation phase. In a second rotation phase control (β), the CPU 115 outputs an acceleration signal 601 in the same manner as in the first rotation phase control (α). However, the CPU 115 outputs a deceleration signal 602 with an output frequency lower than that in the first rotation phase control (α). FIG. 6 illustrates an example in which the output frequency of the deceleration signal 602 in the second rotation phase control (β) is half the output frequency of the deceleration signal 302 in the first rotation phase control (α).

When the rotation speed of a scanner motor 203*y* is low, it is desired to prioritize an acceleration instruction under the rotation speed control to bring the rotation speed to the target speed more quickly. When the rotation speed control and the rotation phase control are performed in parallel, a deceleration instruction under the rotation phase control may lengthen the activation time or may destabilize the rotation control of the scanner motor 203*y*. Therefore, when the rotation speed of the scanner motor 203*y* is low, the second rotation phase control (β) is performed to reduce the frequency of the deceleration signal as much as possible. Then, executing the first rotation phase control (α) after the rotation speed of the scanner motor 203*y* becomes faster to some extent makes it possible to stabilize the rotation control and shorten the activation time. The output frequency of the deceleration signal 602 in the second rotation phase control (β) needs not be decreased at a constant rate. For example, the output frequency may be changed according to the rotation speed of the scanner motor 203*y*. Alternatively, the rotation control may be performed so as not to output the deceleration signal 602.

Figure 7:
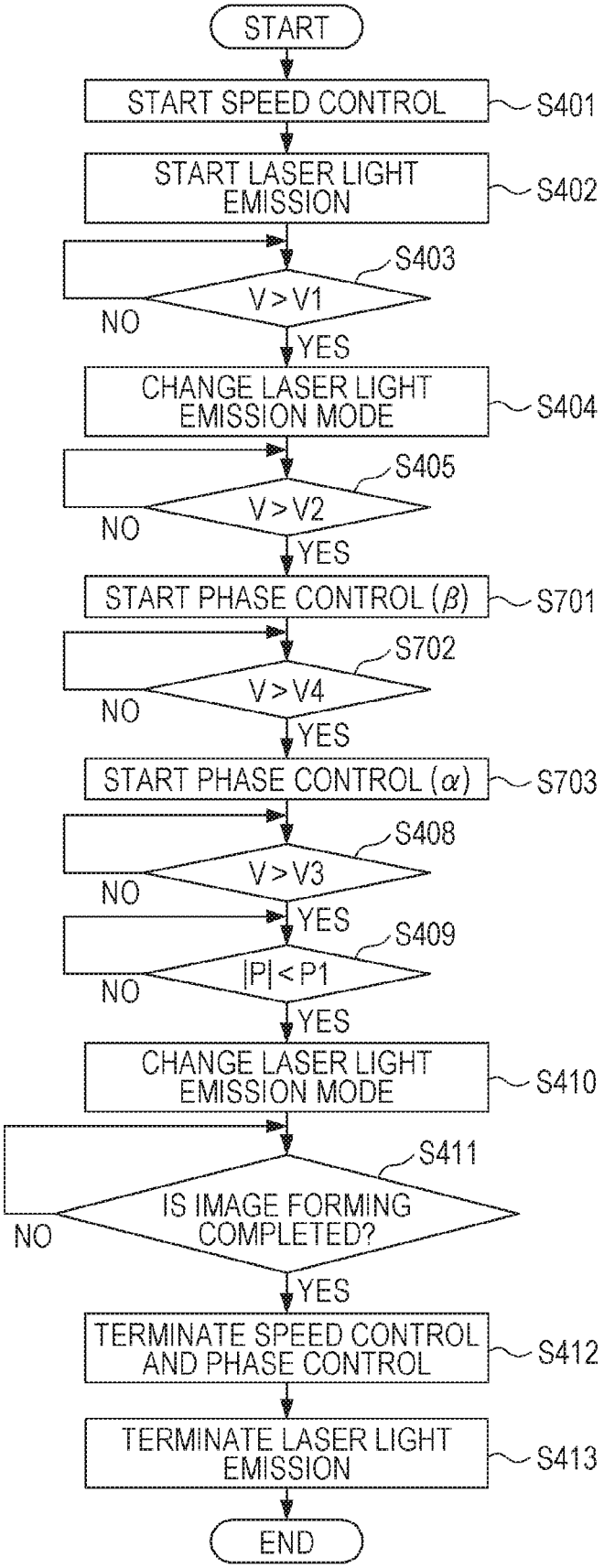
FIG. 7 is a flowchart relating to the rotation control of the laser scanner.

FIG. 7 is a flowchart relating to the rotation control of a laser scanner in the present embodiment. The same steps as those in the flowchart of FIG. 4 are given the same numbers, and detailed descriptions thereof will be omitted here. First, S401 to S405 after activation of the laser scanner unit 103*y* are the same as described in FIG. 4, and thus descriptions thereof will be omitted here. In S701, the CPU 115 starts the rotation phase control of the laser scanner unit 103*y*. In the present embodiment, first, the CPU 115 executes the second rotation phase control (β) when the rotation speed of the scanner motor 203*y* is lower than a predetermined speed. In the second rotation phase control (β), the CPU 115 calculates the BD phase difference between the reference BD signal 207*r* and the BD signal 207*y* and performs either acceleration or deceleration control. However, as described above with reference to FIG. 6, the CPU 115 lowers the output frequency of the deceleration signal 602 so as not to disturb the acceleration of the scantier motor 203*y*.

In S702, the CPU 115 determines whether the rotation speed V of the scanner motor 203*y* has reached a predetermined rotation speed V4. When the rotation speed V of the scanner motor 203*y* has reached the rotation speed V4, in S703, the CPU 115 sets the light emission mode of the semiconductor laser 201*y* to execute the first rotation phase control (α) when the rotation speed of the scanner motor 203*y* is higher than the predetermined speed. As in the first embodiment, in the first rotation phase control (α), the CPU 115 outputs an acceleration signal 301 or a deceleration signal 302 on the basis of the phase difference between the reference BD signal 207*r* and the BD signal 207*y* to control the rotation phase. Hereinafter, S408 to S413 are the same as described in FIG. 4, and thus detailed descriptions thereof will be omitted here.

In this manner, when the rotation speed V of the scanner motor 203*y* is lower than the predetermined speed, the frequency of the deceleration instruction under the phase control is decreased to reduce the influence of decelerating the scanner motor 203*y*, thereby achieving stable activation control. In the present embodiment, in the second rotation phase control (β), the output frequency of the deceleration signal 602 is lowered, but the present invention is not limited to this. For example, the same control can be performed by changing the control gain so as to shorten the output signal width of the deceleration signal 602 according to the rotation speed of the scanner motor 203*y* to reduce the influence of the deceleration instruction under the rotation phase control.

Third Embodiment

In the first embodiment, the cycle of the reference BD signal 207*r* serving as the reference of the rotation phase is calculated based on the average value of the cycles of the BD signals 207*y*, 207*m*, 207*c*, and 207*bk*. Then, the cycle of the reference BD signal 207*r* is dynamically changed based on the calculated average value as described above. In relation to the present embodiment, a method of using one of BD signals 207*y*, 207*m*, 207*c*, and 207*bk* as a reference BD signal for rotation phase control will be described. Detailed descriptions of components similar to those of the first embodiment such as the components of an image forming apparatus will be omitted here.

Figure 8:
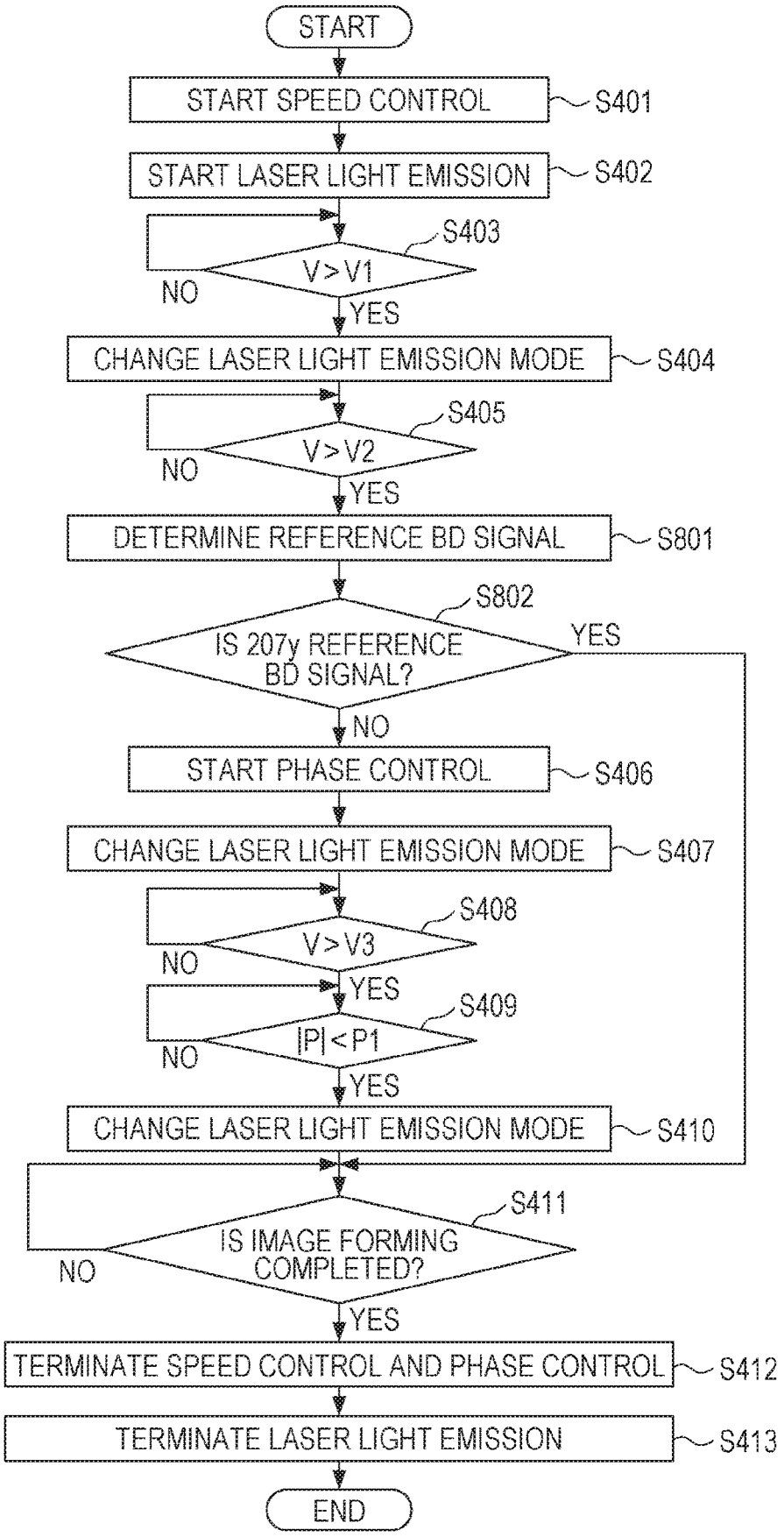
FIG. 8 is a flowchart relating to the rotation control of the laser scanner.

FIG. 8 is a flowchart relating to the rotation control of a laser scanner in the present embodiment. The same steps as those in the flowchart of FIG. 4 are given the same numbers, and detailed descriptions thereof will be omitted here. First, S401 to S405 after activation of the laser scanner unit 103*y* are the same as described in FIG. 4, and thus descriptions thereof will be omitted here. In S801, the CPU 115 determines the reference BD signal 207*r* to be used in the rotation phase control. In this case, the CPU 115 determines one of the scanner motors 203*y*, 203*m*, 203*c*, and 203*bk* that has reached first the rotation speed V2 in all the laser scanners of the laser scanner units 103*y*, 103*m*, 103*c*, and 103*bk*. Then, the CPU 115 determines the BD signal output from the laser scanner unit that has the scanner motor having reached first the rotation speed V2, as the reference BD signal. The CPU 115 performs rotation phase control with reference to the reference BD signal on the laser scanner units without the reference BD signal.

In S802, the CPU 115 determines whether the BD signal 207*y* is the reference BD signal. When the BD signal 207*y* is the reference BD signal, it is not necessary to execute the rotation phase control on the laser scanner unit 103*y*, thus the CPU 115 continues the rotation speed control. On the other hand, when the BD signal 207*y* is not the reference BD signal, the CPU 115 proceeds to S406 to perform the rotation phase control on the laser scanner unit 103*y*. Hereinafter, S406 to S413 are the same as described in FIG. 4, and thus detailed descriptions thereof will be omitted here.

In this manner, the reference BD signal as the reference of the rotation phase control can be set appropriately from among the laser scanner units 103*y*, 103*m*, 103*c*, and 103*bk*. This makes it possible to execute the rotation phase control with reference to the laser scanner unit that has rotated first in a stable manner. The reference BD signal can be selected at each activation of the laser scanner units.

According to embodiments of the present invention, it is possible to suppress an increase in the time taken to start image forming.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-081554, filed Apr. 20, 2018, and No. 2019-022805, filed Feb. 12, 2019, which are hereby incorporated by reference herein in their entirety.

What is claimed is:

1. An image forming apparatus comprising:

a first light source;

a first rotational polygon mirror having a plurality of reflecting surfaces and configured to deflect light emitted from the light source while rotating;

a first drive unit configured to drive the first rotational polygon mirror;

a first detection unit configured to detect the light deflected by the first rotational polygon mirror;

a second light source;

a second rotational polygon mirror having a plurality of reflecting surfaces and configured to deflect light emitted from the light source while rotating;

a second drive unit configured to drive the second rotational polygon mirror;

a second detection unit configured to detect the light deflected by the second rotational polygon mirror; and a control unit configured to control driving of the first drive unit based on a result detected by the first detection unit, control driving of the second drive unit based on a result detected by the second detection unit, and control a period during which light is emitted from the first light source and the second light source, wherein the control unit causes the first light source and the second light source to irradiate an image region on a photosensitive member with light to form an electrostatic latent image, and causes the first light source and the second light source to irradiate a non-image region outside of the image region with light so that the first detection unit and the second detection unit detect the light, and wherein, in a rising period in which the first rotational polygon mirror and the second rotational polygon mirror are accelerated to reach a rotation speed for image forming, in a case of performing a first rotation control for controlling rotation speeds of the first rotational polygon mirror and the second rotational polygon mirror, the control unit causes the first light source and the second light source to irradiate the non-image region with light in a first period and independently controls the rotation speeds of the first rotational polygon mirror and the second rotational polygon mirror, and in the rising period, in a case of performing a second rotation control to match a rotation phase of the first rotational polygon mirror with a rotation phase of the second rotational polygon mirror, the control unit controls a period during which both or one of the first light source and the second light source irradiate the non-image region with light to be a second period longer than the first period.

2. The image forming apparatus according to claim 1, wherein, in a case of performing the second rotation control, the control unit controls a timing of emitting light from both or one of the first light source and the second light source to attain the second period longer than the first period.

3. The image forming apparatus according to claim 2, wherein in a case of performing the first rotation control, the control unit performs a control to cause the first light source to emit light based on a timing obtained by multiplying a cycle of a signal detected by the first detection unit by a first coefficient, and to cause the second light source to emit light based on a timing obtained by multiplying a cycle of a signal detected by the second detection unit by the first coefficient, and in a case of performing the second rotation control, the control unit performs a control to cause the first light source to emit light based on a timing obtained by multiplying the cycle of the signal detected by the first detection unit by a second coefficient smaller than the first coefficient, and to cause the second light source to emit light based on a timing obtained by multiplying the cycle of the signal detected by the second detection unit by the second coefficient.

4. The image forming apparatus according to claim 1, wherein the control unit performs the first rotation control until the rotation speeds of the first rotational polygon mirror and the second rotational polygon mirror reach a predetermined speed, and the control unit performs the second rotation control after the rotation speeds of the first rotational polygon mirror and the second rotational polygon mirror have reached the predetermined speed.

5. The image forming apparatus according to claim 1, wherein the control unit performs the first rotation control until a predetermined time elapses since the rotation of the first rotational polygon mirror and the second rotational polygon mirror is started, and the control unit performs the second rotation control after the predetermined time has elapsed.

6. The image forming apparatus according to claim 1, wherein, under the second rotation control, when a phase difference between the rotation phase of the first rotational polygon mirror and the rotation phase of the second rotational polygon mirror becomes smaller than a predetermined value, the control unit switches to the first rotation control.

7. The image forming apparatus according to claim 1, wherein the control unit compares a cycle of a signal output in response to the detection of the light by the first detection unit and the second detection unit with a cycle of a signal as a reference, and performs rotation phase control by accelerating or decelerating both or one of the rotation speeds of the first rotational polygon mirror and the second rotational polygon mirror in accordance with a comparison result.

8. The image forming apparatus according to claim 1, wherein, before performing the first rotation control and the second rotation control, the control unit performs a control to perform forced light emission to cause the first light source and the second light source to irradiate both the image region and the non-image region with light.

9. The image forming apparatus according to claim 8, wherein the control unit performs a control to perform the forced light emission by irradiating an entire region in a main scanning direction as a direction of light scanning with light.

10. The image forming apparatus according to claim 1, wherein, in a case of matching the rotation phases by decelerating the first rotational polygon mirror during the second rotation control, when the rotation speed of the first rotational polygon mirror is a first speed, the control unit performs a control to output a deceleration instruction for controlling the rotation phase of the first rotational polygon mirror at a first frequency, and when the rotation speed of the first rotational polygon mirror is a second speed higher than the first speed, the control unit performs a control to output the deceleration instruction at a second frequency higher than the first frequency.

11. The image forming apparatus according to claim 1, wherein, in a case of matching the rotation phases by decelerating the first rotational polygon mirror during the second rotation control, when the rotation speed of the first rotational polygon mirror is a first speed, the control unit performs a control to output a deceleration instruction for controlling the rotation phase of the first rotational polygon mirror for a first length, and when the rotation speed of the first rotational polygon mirror is a second speed higher than the first speed, the control unit performs a control to output the deceleration instruction for a second length larger than the first length.

12. The image forming apparatus according to claim 1, wherein, in a case of performing the second rotation control, the control unit achieves rotation phase matching by accelerating, in priority to decelerating, both or one of the rotation speeds of the first rotational polygon mirror and the second rotational polygon mirror.

13. The image forming apparatus according to claim 1, wherein the control unit sets a cycle obtained by averaging cycles of signals detected by the first rotational polygon mirror and the second rotational polygon mirror as a cycle of a signal serving as a reference in the second rotation control.

14. The image forming apparatus according to claim 1, wherein the control unit sets one of cycles of signals detected by the first rotational polygon mirror and the second rotational polygon mirror as a cycle of a signal serving as a reference in the second rotation control.

15. The image forming apparatus according to claim 14, wherein the control unit sets a cycle of a signal from the first rotational polygon mirror or the second rotational polygon mirror at the highest rotation speed as a cycle of a signal serving as a reference in the second rotation control.

16. An image forming apparatus comprising:

a first light source;

a first rotational polygon mirror having a plurality of reflecting surfaces and configured to deflect light emitted from the light source while rotating;

a first drive unit configured to drive the first rotational polygon mirror;

a first detection unit configured to detect the light deflected by the first rotational polygon mirror;

a second light source;

a second rotational polygon mirror having a plurality of reflecting surfaces and configured to deflect light emitted from the light source while rotating;

a second drive unit configured to drive the second rotational polygon mirror;

a second detection unit configured to detect the light deflected by the second rotational polygon mirror; and a control unit configured to control driving of the first drive unit based on a result detected by the first detection unit, control driving of the second drive unit based on a result detected by the second detection unit, and control a period during which light is emitted from the first light source and the second light source, wherein the control unit causes the first light source and the second light source to irradiate an image region on a photosensitive member with light to form an electrostatic latent image, and causes the first light source and the second light source to irradiate a non-image region outside of the image region with light so that the first detection unit and the second detection unit detect the light, and wherein, in a rising period in which the first rotational polygon mirror and the second rotational polygon mirror are accelerated to reach a rotation speed for image forming, the control unit performs a control to match a rotation phase of the first rotational polygon mirror with a rotation phase of the second rotational polygon mirror.

* * * * *